US010477308B2

(12) United States Patent
van Halteren

(10) Patent No.: US 10,477,308 B2
(45) Date of Patent: Nov. 12, 2019

(54) CIRCUIT AND A RECEIVER COMPRISING THE CIRCUIT

(71) Applicant: Sonion Nederland B.V., Hoofddorp (NL)

(72) Inventor: Aart Zeger van Halteren, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/858,231

(22) Filed: Dec. 29, 2017

(65) Prior Publication Data

US 2018/0192187 A1 Jul. 5, 2018

(30) Foreign Application Priority Data

Dec. 30, 2016 (EP) ..... 16207546

(51) Int. Cl.

| | |
|---|---|
| ***H04R 3/00*** | (2006.01) |
| ***H04R 11/02*** | (2006.01) |
| ***H04R 25/00*** | (2006.01) |
| ***H04R 7/02*** | (2006.01) |
| ***H04R 1/10*** | (2006.01) |

(52) U.S. Cl.

CPC ..... *H04R 3/00* (2013.01); *H04R 7/02* (2013.01); *H04R 11/02* (2013.01); *H04R 25/305* (2013.01); *H04R 1/1041* (2013.01); *H04R 2225/33* (2013.01); *H04R 2225/59* (2013.01); *H04R 2420/03* (2013.01)

(58) Field of Classification Search

CPC . H04R 3/00; H04R 7/02; H04R 11/02; H04R 25/305; H04R 1/1041; H04R 2225/33; H04R 2225/59; H04R 2420/03

See application file for complete search history.

(56) References Cited

U.S. PATENT DOCUMENTS

| | | | |
|---|---|---|---|
| 4,689,819 | A | 8/1987 | Killion |
| 6,310,960 | B1 | 10/2001 | Saaski |
| 6,600,825 | B1 | 7/2003 | Leysieffer |
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |

(Continued)

FOREIGN PATENT DOCUMENTS

| | | |
|---|---|---|
| EP | 0982971 | 3/2000 |
| EP | 1331835 | 7/2003 |

(Continued)

*Primary Examiner* — Mohammad K Islam

(74) *Attorney, Agent, or Firm* — Nixon Peabody LLP

(57) ABSTRACT

A circuit and a receiver comprising the circuit, the circuit is able to either feed a received signal directly to the receiver coil or amplify the signal before transmission to the coil. The circuit receives a supply power and amplifies the input signal if the supply power exceeds a threshold value.

11 Claims, 1 Drawing Sheet

(56) References Cited

U.S. PATENT DOCUMENTS

| | | | |
|---|---|---|---|
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,426 | B1 | 4/2007 | Julstrom |
| 7,206,428 | B2 | 4/2007 | Geschiere |
| 7,221,767 | B2 | 5/2007 | Mullenborn |
| 7,221,768 | B2 | 5/2007 | Sjursen |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 7,987,977 | B2 | 8/2011 | Leedom |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 8,649,540 | B2 | 2/2014 | Killion |
| 9,426,587 | B2 | 8/2016 | Stoffels |
| 2008/0069376 | A1* | 3/2008 | Rashid ..... H03F 1/305 381/94.5 |
| 2010/0310097 | A1* | 12/2010 | Chang ..... H04M 1/6058 381/120 |
| 2011/0182453 | A1 | 7/2011 | van Hal |
| 2011/0189880 | A1 | 8/2011 | Bondo |
| 2011/0216929 | A1 | 9/2011 | Jang |
| 2011/0255698 | A1* | 10/2011 | Young ..... H03G 3/341 381/28 |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0133432 | A1* | 5/2012 | Gehrke ..... H03G 1/0088 330/131 |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0148818 | A1* | 6/2013 | Yamkovoy ..... H04R 1/1041 381/74 |
| 2013/0163776 | A1* | 6/2013 | Yamkovoy ..... H04R 1/1083 381/72 |
| 2013/0163799 | A1 | 6/2013 | Van Halteren |
| 2013/0195295 | A1 | 8/2013 | van Halteren |
| 2014/0050330 | A1* | 2/2014 | Allen ..... H04R 3/00 381/74 |
| 2014/0294191 | A1* | 10/2014 | Parkins ..... A61F 11/06 381/72 |
| 2014/0375381 | A1* | 12/2014 | Lin ..... H03F 3/189 330/124 R |
| 2015/0189447 | A1* | 7/2015 | Vinter ..... H04R 25/30 381/323 |
| 2015/0256941 | A1 | 9/2015 | Bymaster |
| 2016/0142832 | A1 | 5/2016 | Hillbratt et al. |
| 2017/0359652 | A1* | 12/2017 | Serwy ..... H03F 3/183 |
| 2018/0027330 | A1* | 1/2018 | Rand ..... G06F 13/387 |

FOREIGN PATENT DOCUMENTS

| | | |
|---|---|---|
| EP | 1617704 | 1/2006 |
| EP | 2663095 | 11/2013 |
| EP | 2890155 | 7/2015 |
| EP | 2908556 | 8/2015 |
| WO | WO 2016/209295 | 12/2016 |

* cited by examiner

CIRCUIT AND A RECEIVER COMPRISING THE CIRCUIT

The present invention relates to a receiver or other sound generator comprising a circuit comprising one or more amplifiers which may be used for amplifying an input signal before transmission to the receiver coil. The amplification may be made dependent on a supply voltage to the circuit, such as to the amplifiers, so that for example amplification, only takes place, if the supply voltage exceeds a predetermined threshold value.

Receivers may be seen in e.g. EP1331835, EP0982971, U.S. Pat. No. 6,310,960, US2015/0256941, U.S. Pat. Nos. 7,221,768, 7,206,426, 8,649,540, 7,987,977, 6,600,825, WO2016/209295, US2011/216929, EP2908556, US2016/142832, EP2890155 and U.S. Pat. No. 4,689,819.

In general, the use of an amplifier for amplifying an audio signal will increase the signal strength of the audio signal but also the noise and distortion thereof. In addition, amplifiers require power and thus will act to swifter depletion of the battery. Thus, careful consideration is desires as to when to operate amplifiers in receivers. The present invention relates to set-ups where amplifiers may be operated or not.

In a first aspect, the invention relates to a method of operating a sound generator, the method comprising:

1. receiving an audio signal,
2. receiving a supply voltage,
3. if the supply voltage does not exceed a threshold voltage, feeding the received audio signal to the sound generator, the received audio signal having a first signal strength,
4. if the supply voltage exceeds the threshold voltage:
   a) feeding the supplied voltage to an amplifier,
   b) feeding the audio signal to the amplifier, and
   c) feeding the amplified audio signal to the sound generator, the amplified audio signal having a second signal strength exceeding the first signal strength.

In the present context, the sound generator may be that of a hearing aid, hearable or other personal communication device, such as a Bluetooth device. The sound generator may be configured to be positioned at or in the ear of a person or be a portion of an element positioned at or in the ear of a person. A sound guide, such as a channel, may be provided for guiding sound from the sound generator to or into the ear canal of a person.

In one embodiment, the sound generator is a miniature sound generator, such as a sound generator with a largest dimension of no more than 10 mm, such as no more than 8 mm, such as no more than 6 mm or no more than 5 mm.

In this context, the audio signal may be a signal having contents which define an audio signal when fed to, such as directly to, a sound generator. Thus, the signal may, over time, define a vibration or frequency components generally within the audible frequency interval of 20 Hz-20 kHz or a narrower interval within that range. The audio signal may be encoded, such as on to a digital form. A digital audio signal may be pulse width modulated or pulse density modulated, for example. The audio signal may alternatively be analogue, naturally.

The audio signal may be an electrical signal and/or be received from a source, such as a microphone, a processor, one or more electrical conductors or the like.

Often, the audio signal is generated by another component, such as a DSP, processor, controller an amplifier or the like (see below).

The supply voltage may be a DC voltage or an AC voltage. The supply voltage compared to the threshold voltage may be a DC voltage, an AC voltage or a calculated voltage, such as a maximum voltage, a mean voltage or the like. If the supply voltage varies, such as if a maximum value thereof varies, a mean value taken over a predetermined period of time may be used. A varying DC voltage may be received from a battery slowly being depleted. The voltage thus may be a present value or a value taken over e.g. the last minute, the last hour or the like.

The threshold voltage may be pre-set for the life time of the product or may be varied. The supply voltage is fed to the amplifier, whereby the maximum output of the amplifier may depend on the supply voltage. Thus, the supply voltage may be varied to obtain a desired output of the amplifier. Then, the threshold voltage may be varied to determine when amplification sets in.

Alternatively, the same sound generator may be used for different purposes depending on whether, for example, a supply voltage is available or not.

When the supply voltage is below the threshold value (such as if it is not present at all), the received audio signal is fed to the sound generator, such as without amplification or around (not through) the amplifier. This feeding to the sound generator preferably is without any significant signal loss, such as not through any electrical components other than conductors and/or switches.

When the supply voltage equates or exceeds the threshold voltage, the supplied voltage is fed to the amplifier. Naturally, any supply voltage provided may always be fed to the amplifier.

Also, the audio signal is fed to the amplifier. Naturally, the received audio signal may always be fed to the amplifier and perhaps also amplified, where the amplified signal is then only fed to the sound generator when the supply voltage equates or exceeds the threshold voltage.

Alternatively, the audio signal is not fed to the amplifier, when the supply voltage is not high enough, so that no amplified audio signal is output in that situation.

Yet alternatively, no supply voltage is fed to the amplifier, when the supply voltage is too low. Then, any audio signal, if fed to the amplifier, would not be amplified anyway.

Usually, the gain of the amplifier is above 1, which means that the amplified audio signal has a higher intensity or signal strength, usually a higher voltage, than the audio signal fed to the amplifier.

The amplified audio signal has the second signal strength which exceeds the first signal strength. The difference or factor may be the gain of the amplifier.

Preferably, the amplified audio signal and the received audio signal correspond to each other. In one embodiment, the frequency contents of the two signals are the same, where the difference is the signal strength. Naturally, a filtering may be applied. Filters may be configured to be switched on/off and may be implemented acoustically or electrically.

In one embodiment, the received audio signal is fed, in step 3, to the sound generator without amplification or filtering. Then, the received audio signal, in step 4, may be amplified and fed to the sound generator without filtering.

In one embodiment, the threshold voltage may be varied in relation to the first signal strength, such as a mean value of the first signal strength over a predetermined period of time, such as 1, 2, 3, 5, 10, 20, 30 seconds or the like. The maximum output voltage of an amplifier often relates to the supply voltage thereto. Thus, if the supply voltage is low, an even lower audio signal may still be amplified, where a higher intensity audio signal might not be, if it exceeds the supply voltage available.

In one embodiment, the threshold voltage may be defined on the basis of a desired sound output intensity from the sound generator, such as based on a determined sound intensity in the surroundings of the sound generator, such as the surroundings of a person or at an eardrum of the person. Then, if the sound intensity determined is high, a higher threshold may be selected compared to if the intensity determined is low. A higher determined sound intensity may be in a crowded or loud room, such as at a concert, where a lower intensity may be seen if a person whispers to a user of a hearing aid or hearable with the present system. When an audio signal is fed to the sound generator, be it the received audio signal or the amplified audio signal, sound may be generated by the sound generator.

In one embodiment, a control signal is received and wherein step 4. comprises:

4. if the supply voltage exceeds the threshold voltage:
   aa) if the control signal so indicates, feeding the received audio signal to the sound generator,
   bb) if not:
      i) feeding the supplied voltage to an amplifier,
      ii) feeding the audio signal to the amplifier, and
      iii) feeding the amplified audio signal to the sound generator.

Thus, steps 4. bb) i)-iii) correspond to steps 4. a)-c). Thus, the method further comprises the step of receiving a control signal, and wherein step 4. comprises feeding the received audio signal to the sound generator, if the control signal so indicates and otherwise performing steps a), b) and c).

The control signal may be received via a wireless connection and/or a wired connection, such as on a wire used also for feeding the audio signal and/or the supply voltage. The control signal may be received from e.g. a DSP providing also the audio signal and which may perform filtering of the audio signal and may perform other algorithms and controlling, such as receiving and selecting among audio signals from different sources. The control signal may be digital or analog and may be fed via separate wires or not.

The control signal represents at least one condition and/or value which may be interpreted to describe whether the audio signal received is to be fed to and through the amplifier as described above, or whether the audio signal is to be fed to the sound generator as also described above. Thus, even if the supply voltage exceeds the threshold voltage, the control signal may define that the received audio signal is nevertheless to be fed to the sound generator.

The control signal thus may comprise therein one of a plurality of values, of which one or more values may indicate that the received audio signal is to be amplified and one or more other values indicate that it is not. Alternatively, a presence of the control signal may be taken as an indication that the received audio signal is to be amplified and an absence of the control signal may be taken as an indication that the received audio signal is not to be amplified—or vice versa.

In one embodiment, step 1. comprises receiving the audio signal on a first and a second input terminal of a circuit also comprising:

a first and a second output terminal, the first and second output terminals connected to the sound generator,
a first amplifier having an input and an output,
a second amplifier having an input and an output, and
a first and a second switch, where step 3. (and/or step 4. aa)) comprises:

the first switch (and the third switch when present) connecting the first input terminal to the first output terminal, and
the second switch (and the fourth switch when present) connecting the second input terminal to the second output terminal and where step 4. (and/or step 4. bb)) comprises:

the first switch (and the third switch when present) connecting the first input terminal to the input of the first amplifier and/or the output of the first amplifier to the first output terminal and
the second switch (and the fourth switch when present) connecting the second input terminal to the input of the second amplifier and/or the output of the second amplifier to the second output terminal.

Thus, the switches act to guide the signals as determined in the method.

In this context, a switch may be any type of component capable of receiving a signal and forwarding it to any of at least two outputs or conductors. A switch may be a standard switch or a more complex circuit, such as two on/off contacts (such as transistors) each receiving the signal and where one is controlled to be on and the other off.

A terminal usually is an electrically conducting element and/or surface at which the signal may be input or output. A terminal may be a conductor surface to which a conductor may be attached, such as by soldering, gluing or press fitting, or a conductor of any other type to which connection may be made to another conductor carrying the audio signal or receiving the output signal.

An amplifier, as mentioned above, may be an element configured to receive an input signal and output an amplified signal with an (usually higher) output intensity (usually voltage). As mentioned above, the gain may be above 1, below 1 or identical to 1 for that matter.

The amplifier may, for example, be based on one or more transistors. The amplifiers may be embodied in the same circuit if desired.

In one embodiment, a gain input signal may be received, where step 4. (or step 4. bb) comprises one of or both of the amplifiers amplifying the pertaining, received signal with a gain as represented by the gain input signal. If desired, different gains may be selected for the amplifiers, such as when the gain input signal represents two different gains.

As will be described below, the operation of the switches preferably is handled by four switches, so that for each of the above two switches, two are preferably provided; one for coupling the received audio signal to the amplifier input or the second switch and another for coupling the output terminal to the amplifier output or the first switch.

Another aspect of the invention relates to an assembly of a sound generator and a circuit, the sound generator comprising a coil having a first and a second coil terminal, and the circuit comprising:

a first and a second input terminal,
a first and a second output terminal, the first output terminal connected to the first coil terminal and the second output terminal connected to the second coil terminal,
a first amplifier having an input and an output,
a second amplifier having an input and an output,
a first and a second switch,
the first switch being configured to either
   1) connect the first input terminal to the input of the first amplifier or the output of the first amplifier to the first output terminal and
   2) connect the first input terminal to the first output terminal, and the second switch being adapted to either:

1) connect the second input terminal to the input of the second amplifier or the output of the second amplifier to the second output terminal, when the first switch either connects the first input terminal to the input of the first amplifier or the output of the first amplifier to the first output terminal, and
2) connect the second input terminal to the second output terminal, when the first switch connects the first input terminal to the first output terminal.

In this context, the considerations, steps and elements of the above and below aspects are equally relevant in this aspect of the invention.

Thus, the sound generator preferably is an element configured to receive an electrical signal and output a corresponding sound, where "corresponding" preferably means that at least some frequency contents of the electrical signal are provided also in the sound generated. A sound generator may also be called a loudspeaker or a receiver, which is a usual term in hearing aids and hearables.

The circuit preferably is a single circuit where the terminals, switches and amplifiers and any electrical conductors are provided in a monolithic unit, such as on or attached to a single Printed Circuit Board. However, the circuit may be provided as multiple elements connected to each other. Also, additional components, such as power supplying conductors, control conductors, a DSP, and the like may be provided if desired.

The sound generator has a coil. Usually, the coil is configured to receive the electrical signal to generate, in the coil, an electrical field corresponding to the electrical signal, where "corresponding" preferably means that at least some frequency contents of the electrical signal are provided also in the electrical field generated. This electrical field is provided to a magnet or a magnetically conducting element positioned in a magnetic field, so that a relative movement takes place between on the one hand, the magnet or magnetic field, and on the other hand the coil or the conducting element. This movement may be used for moving an element causing air pressure variations and thus emitting sound.

The coil has two terminals for receiving the electrical signal. Usually, the terminals are at either end of a coiled conductor constituting the coil.

The input and output terminals may, as described above, be conducting surfaces configured for attachment to electrical conductors. If the circuit is provided in a housing, the terminals may be provided on or accessible from the outside of the housing.

The output terminals are connected to the coil. Preferably, no other components are provided between the coil and the output terminals.

Each amplifier has an input and an output. Naturally, the amplifier may have multiple inputs and/or multiple outputs. Usually, as was mentioned above, the amplifier also is configured to receive the supply voltage, where the maximum output voltage of the amplifier relates to, and usually is identical to or close to, the supply voltage. Amplifiers may also have a programmable gain and thus a gain input signal for controlling the gain.

A switch is configured to receive a signal and feed it to one of a plurality of outputs. A switch may be a monolithic element or an assembly of elements. Often, the switch is controllable by a control signal to determine which output to switch the received signal to. Often, switches do not perform any adaptation of the signal during the switching. Adaptation, such as filtering, amplification or the like, may, however be performed if desired.

The first and the second switches are configured to either feed the pertaining, received input signal to the pertaining output terminal or through the pertaining amplifier.

Naturally, other setups may be used, such as a setup using additional switches.

In one embodiment, the circuit further comprises a third and a fourth switch, wherein:

the first and third switches are configured to either 1) connect the first input terminal to the input of the first amplifier and the output of the first amplifier to the first output terminal or
2) connect the first input terminal to the first output terminal, and the second and fourth switches are adapted to either:

1) connect the second input terminal to the input of the second amplifier and the output of the second amplifier to the second output terminal, when the first and third switches connect the first input terminal to the input of the first amplifier and the output of the first amplifier to the first output terminal, and
2) connect the second input terminal to the second output terminal, when the first and third switches connect the first input terminal to the first output terminal.

Thus, the first switch may connect the first input terminal to either the input of the first amplifier or to the third switch (or a conductor connected thereto), and the third switch may connect the first output terminal to either the output of the amplifier or the first switch (or the conductor). A similar set-up may be used for the second/fourth switches.

Naturally, additional components may be connected between the first and third switches and e.g. the amplifier. Thus, additional circuitry may be provided in the path taken by the signal from the first (second) input terminal to the first (second) output terminal either when the signal is amplified or when it is not. Such circuitry may be e.g. a filter, as is described below. Such circuitry may be provided only between the first input/output terminals or also between the second input/output terminals.

Any type of controlling of the switches may be applied.

In one situation, the switches may be controlled on the basis of a supply voltage, so that different modes of operation may be achieved when the supply voltage is high or low.

In one embodiment, the assembly further comprises a voltage input terminal connected to voltage supplies of the first and second amplifiers, and a controller connected to the voltage input terminal, the controller being configured to control the first and second switches, or the first-fourth switches in the embodiment where also the third and fourth switches are used.

Naturally, the controller may control the switches on the basis of a voltage supplied by the voltage input terminal. In a simple manner, the switches may be controlled to be in one state when the voltage supplied is below a threshold voltage and in the (or an) other state when the voltage supplied is above the threshold voltage, such as when the controller is configured to, when the voltage supplied to the voltage input terminal is below a predetermined voltage:

control the first (and when applicable, third) switch(es) to connect the first input terminal to the first output terminal and control the second (and when applicable, fourth) switch(es) to connect the second input terminal to the second output terminal.

Also, the controller may be configured to, when the voltage supplied to the voltage input terminal is above a predetermined voltage:

control the first (and when applicable third) switch(es) to connect the first input terminal to the input of the first amplifier and the output of the first amplifier to the first output terminal, control the second (and when applicable fourth) switch (es) to connect the second input terminal to the input of the second amplifier and the output of the second amplifier to the second output terminal.

Naturally, separate voltage supplies may be provided for the amplifiers. Thus, the control of the amplifiers and switches may also be individual if desired.

The controller may be dispensed with if the switches, for example, are controlled directly by the supply voltage or by a controlling signal received separately from the supply voltage.

The circuit may be built into or assembled with the sound generator, such as on a PCB residing in the sound generator. A PCB may host electrical terminals for wiring with audio signals and/or an external voltage supply. It is also possible to combine the circuit with e.g. a local energy harvesting circuitry and/or a local power storage in the receiver as described in e.g. EP2469705.

In one situation, the assembly further comprises:

a housing defining an inner space, a diaphragm dividing the inner space into at least two chambers, a magnet assembly defining a magnet gap, an armature comprising a portion extending through the magnet gap and the a coil tunnel of the coil, the armature being connected to the diaphragm.

Thus, a standard hearing aid or hearable receiver or speaker for a personal audio device may be provided.

The diaphragm is preferably moved as a consequence of the signal fed through the coil, whereby pressure differences exist in the housing which may be output to the surroundings through a sound opening.

The armature usually is preferably a magnetically conducting element wherein a magnetic field is generated due to the signal in the coil and which therefore is moved due to the magnetic field.

The magnet assembly may comprise one or more magnets, typically permanent magnets. One magnet may be provided with a yoke defining the magnetic gap. Multiple magnets may be provided, such as on either side of the magnetic gap—with or without a yoke for guiding the magnetic field outside of the gap.

The circuit may be provided inside the housing if desired. Then, the input terminals may be electrical conductors provided on an outer side of the housing, where the output terminals are provided inside the housing.

The above control signals and voltage inputs may also be provided on an outer side of the housing.

A final aspect of the invention relates to a circuit for use in the assembly of the second aspect of the invention, the circuit comprising:

a voltage input terminal connected to voltage supplies of the first and second amplifiers, and a controller connected to the voltage input terminal, the controller being configured to control the (first and second or first-fourth) switches.

Naturally, the circuit will also comprise the switches (the first and second and optionally also the third and fourth) as well as the input/output terminals.

In this context, a terminal may be as those described above.

The amplifiers have supply voltage inputs. As mentioned above, the output signal of an amplifier may be defined by or limited by the voltage supplied.

As mentioned, the controller may control the switches on the basis of the supplied voltage, such as selecting a mode or route based on whether the supplied voltage is above or below a threshold value.

Alternatively or additionally, the controller may receive a separate controlling signal, such as a signal from outside of the circuit or the sound generator. This signal may be wireless or transported over a wire, such as via one of the input terminals, the supply voltage terminal or a control signal terminal. This control signal may program the controller to achieve a desired operation.

In one embodiment, as is also described above, the circuit further comprises a third and a fourth switch, wherein:

the first and third switches are configured to either 1) connect the first input terminal to the input of the first amplifier and the output of the first amplifier to the first output terminal and 2) connect the first input terminal to the first output terminal, and the second and fourth switches are adapted to either:

1) connect the second input terminal to the input of the second amplifier and the output of the second amplifier to the second output terminal, when the first and third switches connect the first input terminal to the input of the first amplifier and the output of the first amplifier to the first output terminal and 2) connect the second input terminal to the second output terminal, when the first and third switches connect the first input terminal to the first output terminal.

Then, the controller may be configured to, when the voltage supplied to the voltage input terminal is below a predetermined voltage:

control the first (and optionally third) switch(es) to connect the first input terminal to the first output terminal and control the second (and optionally fourth) switch(es) to connect the second input terminal to the second output terminal.

Also, the controller may be configured to, when the voltage supplied to the voltage input terminal is above a predetermined voltage:

control the first (and optionally third) switch(es) to connect the first input terminal to the input of the first amplifier and the output of the first amplifier to the first output terminal, control the second (and optionally fourth) switch(es) to connect the second input terminal to the input of the second amplifier and the output of the second amplifier to the second output terminal.

In the following, preferred embodiments will be described with reference to the drawing, wherein.

Figure 1:
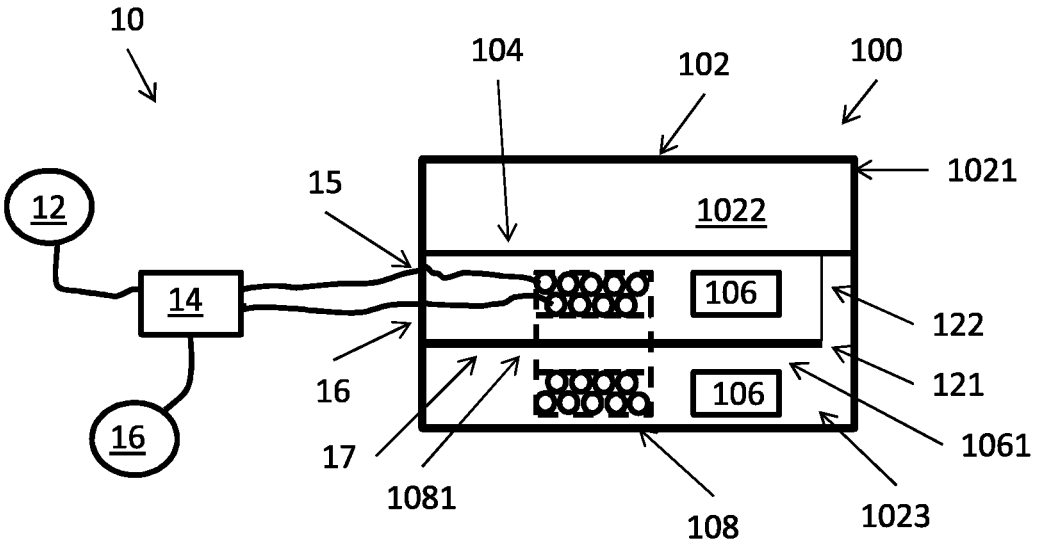
FIG. 1 illustrates the main components of a known receiver.

In FIG. 1, a standard receiver set-up is seen where a hearing aid or a hearable 10 comprises a microphone 12, a battery 16, a controller 14 and a receiver 100 comprising a housing 102 divided into two chambers 1022 and 1023 by a diaphragm 104. The controller 14 feeds, via input terminals 15 and 16, a signal to a coil 108 comprising a number of windings and defining a coil tunnel 1081. The receiver also comprises a magnet assembly 106 defining a magnet air gap 1061. An armature 17 is fixed to the housing and has a flexible arm extending through the coil tunnel 1081 and the magnet air gap 1061 and which is connected, at an end 121 to the diaphragm 104 via a drive pin 122.

The receiver generates sound by receiving a current from the terminals 15/16, whereby an electrical field is generated within the armature, which makes it move due to the interaction with the magnetic field in the air gap. The movement of the diaphragm generates pressure differences in the chambers, whereby sound is output from a sound outlet 1021. A vent may be provided for ensuring pressure equalization of the back chamber.

The controller may be formed on any technology and implemented as a chip, FPGA, ASIC, controller, DSP or the like. The controller may be monolithic or formed by multiple elements communicating with each other.

Systems of this type are adapted to a single supply voltage from the battery 16. Often, the controller 14 is manufactured to suit the voltage of the battery type preferred. Up until now these Controller/DSP's 14 in the hearing aid industry were constructed for ZnO batteries where the maximum voltage is around 1.5 Volt. New, rechargeable batteries have been developed which provide significantly higher voltages on the order of 3-4.2 Volt (depending on the charging level). Using such batteries with the legacy DSPs would require a voltage conversion, which is inefficient and thus consumes power.

In order to adapt the battery voltage to the processor, a DC conversion may be performed. Actually, some processors even for the usual supply voltages have internal DC conversions to even lower voltages in order to e.g. save power.

Naturally, as high a sound intensity as possible is desired, within limits. Naturally, for a given supply voltage, the impedance of the coil could be reduced (see e.g. EP1617704), such as by decreasing the number of windings. This will decrease the voltage drawn from the battery but will increase the current consumption. There is, however, a limit to the current which the battery can provide. Also, a very low impedance will increase the noise level at lower frequencies, which is problematic in that many persons with hearing loss actually has OK hearing at the lower frequencies.

Thus, when no higher voltage is available than that suitable for the controller, so that the output of the controller would be as high as an output of an amplifier fed with the voltage available, the controller output may be fed directly to the coil as usual.

However, when a higher supply voltage is available, the output of the controller may be amplified before transmission to the coil. In this manner, a higher sound output may be obtained. Thus, when the supply voltage exceeds a predetermined voltage, an amplifier circuit may be used.

Figure 2:
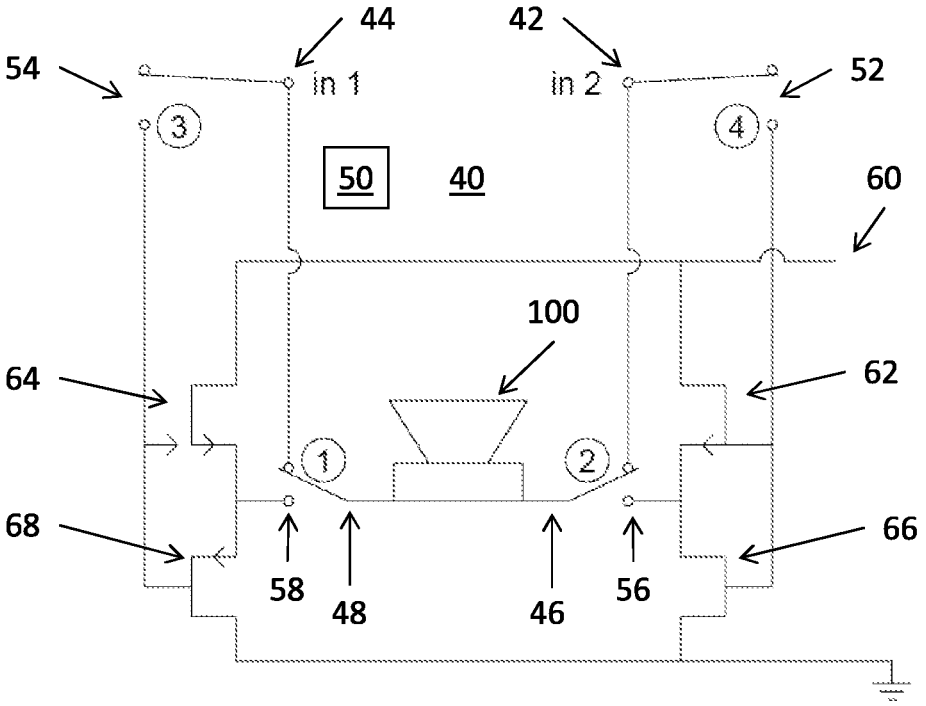
FIG. 2 illustrates a switching circuit according to the invention.

A situation catering for this may be seen in FIG. 2, where a circuit 40 is provided having two input terminals, 42 and 44, and two output terminals, 46 and 48, outputting a signal to the receiver 100, or rather the coil thereof. Actually, the circuit 40 may be provided inside the receiver 100, so that the inputs 42/44 are connected to or embodied as the inputs 15/16.

Four switches, 52, 54, 56 and 58, are provided, as well as transistors 62, 64, 66 and 68 forming two amplifier elements (62/66 combined and 64/68 combined) powered by a supply voltage 60 and ground.

The operation of the circuit 40 is to, when the supply voltage available is lower than a threshold voltage, operate the switches to be in the position illustrated, so that the inputs 42/44 are fed directly to the outputs 46/48 and to the receiver coil.

However, when the supply voltage 60 exceeds the threshold, the switches are brought to their other position, so that the signal from the input 42 is fed to the amplifier formed by transistors 62/66 and thereafter to the output 56 and the receiver, where the signal received on the input 44 is amplified in 64/68 and fed to the receiver via output 58. In this situation, the higher supply voltage will bring about a higher sound output intensity.

Then, the same receiver, with this circuit, may be used for different battery technologies, and/or it may change its mode of operation when e.g. a battery becomes depleted. It may be preferred that the default operation of the circuit is that seen in FIG. 2, where the input into the circuit is fed directly to the output—i.e. the operation of a standard receiver.

Naturally, the four switches may be reduced in number. Thus, the switches 52/54 may be removed and the terminal 44 permanently connected to both conductors which the switches 52 and 54 switch between. Then, the signal received on the terminal 44, for example, is always fed into the input of the amplifier and toward the switch 58. The switch 58 then still decides which signal to feed to the terminal 48.

Alternatively, the switches 56/58 may be removed and the terminal 48 connected to both the amplifier output and the conductor toward the switch 52/54. Then, the switch 52/54 decides where to forward the signal received and thus which signal is eventually fed to the terminals 46/48.

A separate controller 50 may be provided for controlling the switches. Alternatively, a controller provided outside of the circuit 40, such as within the receiver 100 or in any other position.

Naturally, other types of amplifier circuits may be used, such as operational amplifiers. Also, or alternatively, circuitry may be provided for recreating the signal output of the circuit, such as to recreate pulses therein. The pulse rise- and fall times may be altered by e.g. the amplification or cables provided between the DSP (which may be provided in a BTE) and the circuit (which may be provided in an ITC) and preferably are brought back to the desired values or intervals before feeding to the coil.

Usually, the signal fed to the coil and thus the inputs 42/44 is pulse width modulated (PWM) or pulse density modulated (PDM). Then, preferably the transistors are fast enough to have a good pulse rise- and fall time, so as to not affect the modulation and efficiency.

In some receivers configured to receive signals from low power consumption devices, electronics may already be provided in the receiver for power conversion. These electronics may be combined with the circuit 40.

The circuit or receiver can either have a fixed behaviour with respect to supply voltage changes, such as operate in one mode when the supply voltage is below a threshold voltage and in another when the supply voltage exceeds the threshold voltage. In fact, when the supply voltage exceeds the threshold voltage so that it is possible to operate the amplifiers, it may still be decided to feed the signal directly through the circuit. Thus, a controlling signal may be received (wired or wireless) which controls the operation of the circuit, at least when the supply voltage is high enough for the circuit to have a choice to use the amplifiers or not.

Naturally, the circuit/receiver can be freely programmable, such as by a DSP or a user interface (see e.g. EP2663095 and EP1331835).

In the situation where the higher supply voltage is available, the amplifier may additionally be configured to filter the signal received on the input and fed to the output. Usually, this filtering, if performed at all, is performed by an amplifier feeding the signal to the receiver.

This filtering may be the filtering usually performed by other amplifiers in usual hearing aids or hearables, such as to remove certain frequency intervals, attenuation of certain frequency intervals (e.g. for compensating for a resonance frequency) or amplifying certain frequency intervals.

It may be desired to under all circumstances amplify the signal received on the terminals 42/44, whereby an additional amplifier may be provided, or the signal received may be fed into the processor 50 for amplification also.

Identification of the receiver or circuit (see e.g. U.S. Pat. No. 9,426,587) may be used in order to adapt the signal fed thereto either to the terminals 42/44 or for e.g. controlling parameters of the amplification and/or a filtering or the like as described above. This identification may be output on one of the existing wires (for the terminal 42, 44 or 60) or in a separate cross section such as a separate wire or wirelessly.

This filtering may be an attenuation of the signal, such as within a predetermined frequency interval in order to control the power consumption. In many instances it is desired to limit the maximum current drawn from the power source. Usually, the lower frequency portion of the signal contains the most power, so that if the current limit is approaching, it may be desired to attenuate the lower frequency portion of the signal while maintaining the higher frequency portion thereof.

Thus, a current determination may be made in the circuit or in the receiver, which feeds a signal to the processor for this controlling.

Exceeding the maximum current of a battery may shorten the lifetime thereof or cause the battery voltage to become unstable (dips).

Providing a controller within this circuit also allows a portion of the processing of other controllers/DSPs to be distributed to the circuit, such as power supply stabilization, identification of the receiver/circuit or further amplification.

In some situations, multiple, such as two, receivers are desired. This may be to simply increase the sound intensity. Alternatively, a tweeter and a woofer may be provided handling either end of the frequency range.

One circuit 40 could be used for two receivers. In this situation, both receivers are connected, in series or parallel, between the output terminals 46/48.

Alternatively, a separate circuit 40 may be provided for each receiver. In this situation, the above filtering, amplification, power management and the like may be handled separately for each receiver.

It may be desired, when separate circuits are provided, to control the gains of the circuits to e.g. match the vibrations or the vibration frequencies of the two receivers to obtain a vibration suppression over a certain frequency range.

Naturally, the circuit may be autonomous in the sense that it is hard programmed to operate in a particular fashion, such as in the simple case where the switches are operated only on the basis of the supply voltage and the threshold voltage.

However, the circuit offers, as mentioned above, a wide range of functionality and adaptation to different situations, different supply voltages and the like.

Thus, the settings of the controlling of the switches, the threshold voltage, the amplification, the filtering and the like of the amplifiers may be stored in a memory provided in the receiver, for example. Such settings could be fed to the memory or a controller connected thereto from outside of the receiver via a data input. This data input may be a wireless connection or an input wire which, naturally, may be a conductor used also for other purposes, such as for supplying power to the receiver. Thus, this configuration data may be received by the circuit over the wire 60.

Also, this configuration data may be received by the circuit and stored intermittently or permanently, such as in a ROM, FPGA or the like, such as when using fuses, which are burned to stay in a permanent state.

The invention claimed is:

1. A method of operating a sound generator, the method comprising the steps of:

A) receiving an audio signal,

B) receiving a supply voltage,

C) if the supply voltage does not exceed a threshold voltage, feeding the received audio signal to the sound generator, the received audio signal having a first signal strength, D) if the supply voltage exceeds the threshold voltage:

a) feeding the supplied voltage to an amplifier, b) feeding the audio signal to the amplifier, and c) causing the amplified audio signal to be fed to the sound generator, the amplified audio signal having a second signal strength exceeding the first signal strength, where step A) comprises receiving the audio signal on a first and a second input terminal of a circuit also including:

a first and a second output terminal, the first and second output terminals connected to the sound generator, and a first and a second switch, where step B) comprises receiving the supply voltage from a power supply, where step C) comprises:

the first switch connecting the first input terminal to the first output terminal, and the second switch connecting the second input terminal to the second output terminal, and where step D) comprises:

the first switch connecting the first input terminal to an input of a first amplifier or an output of the first amplifier to the first output terminal, and the second switch connecting the second input terminal to an input of a second amplifier or an output of the second amplifier to the second output terminal.

2. An assembly of a sound generator and a circuit, the sound generator comprising a coil having a first and a second coil terminal, the circuit comprising:

a first and a second input terminal, a first and a second output terminal, the first output terminal connected to the first coil terminal and the second output terminal connected to the second coil terminal, a first and a second switch, the first switch being configured to either make a first connection or a second connection, the first connection connecting the first input terminal to an input of a first amplifier or to an output of the first amplifier to the first output terminal and the second connection connecting the first input terminal to the first output terminal, and the second switch being adapted to either make a third connection or a fourth connection:

the third connection connecting the second input terminal to an input of a second amplifier or to an output of the second amplifier to the second output terminal, when the first switch either connects the first input terminal to the input of the first amplifier or the output of the first amplifier to the first output terminal, and the fourth connection connecting the second input terminal to the second output terminal, when the first switch connects the first input terminal to the first output terminal.

3. An assembly according to claim 2, wherein the circuit further comprises a third and a fourth switch, wherein:

the first and third switches are configured to either make a fifth connection or a sixth connection, the fifth connection connecting the first input terminal to the input of the first amplifier and the output of the first amplifier to the first output terminal and the sixth connection connecting the first input terminal to the first output terminal, and the second and fourth switches are adapted to either make a seventh connection or an eighth connection:

the seventh connection connecting the second input terminal to the input of the second amplifier and the output of the second amplifier to the second output terminal, when the first and third switches connect the first input terminal to the input of the first amplifier and the output of the first amplifier to the first output terminal, and the eighth connection connecting the second input terminal to the second output terminal, when the first and third switches connect the first input terminal to the first output terminal.

4. An assembly according to claim 2, further comprising:

a voltage input terminal connected to voltage supplies of the first and second amplifiers, a controller connected to the voltage input terminal, the controller being configured to control the switches.

5. An assembly according to claim 4, wherein the controller is configured to, when the voltage supplied to the voltage input terminal is below a predetermined voltage:

control the first switch to connect the first input terminal to the first output terminal and control the second switch to connect the second input terminal to the second output terminal.

6. An assembly according to claim 4, wherein the controller is configured to, when the voltage supplied to the voltage input terminal is above a predetermined voltage:

control the first switch to connect the first input terminal to the input of the first amplifier and the output of the first amplifier to the first output terminal, control the second switch to connect the second input terminal to the input of the second amplifier and the output of the second amplifier to the second output terminal.

7. An assembly according to claim 2, further comprising:

a housing defining an inner space, a diaphragm dividing the inner space into at least two chambers, a magnet assembly defining a magnet gap, an armature comprising a portion extending through the magnet gap and a coil tunnel of the coil, the armature being connected to the diaphragm.

8. A circuit for use in the assembly according to claim 2, the circuit comprising:

a voltage input terminal connected to voltage supplies of the first and second amplifiers, and a controller connected to the voltage input terminal, the controller being configured to control the switches.

9. A circuit according to claim 8, further comprising a third and a fourth switch, wherein:

the first and third switches are configured to either make a fifth connection or a sixth connection, the fifth connection connecting the first input terminal to the input of the first amplifier and the output of the first amplifier to the first output terminal and the sixth connection connecting the first input terminal to the first output terminal, and the second and fourth switches are adapted to either make a seventh connection or an eight connection:

the seventh connection connecting the second input terminal to the input of the second amplifier and the output of the second amplifier to the second output terminal, when the first and third switches connect the first input terminal to the input of the first amplifier and the output of the first amplifier to the first output terminal and the eight connection connecting the second input terminal to the second output terminal, when the first and third switches connect the first input terminal to the first output terminal.

10. A circuit according to claim 8, wherein the controller is configured to, when the voltage supplied to the voltage input terminal is below a predetermined voltage:

control the first switch to connect the first input terminal to the first output terminal and control the second switch to connect the second input terminal to the second output terminal.

11. A circuit according to claim 8, wherein the controller is configured to, when the voltage supplied to the voltage input terminal is above a predetermined voltage:

control the first switch to connect the first input terminal to the input of the first amplifier and the output of the first amplifier to the first output terminal, control the second switch to connect the second input terminal to the input of the second amplifier and the output of the second amplifier to the second output terminal.

* * * * *